United States Patent [19]

Weigl

[11] 3,950,001

[45] Apr. 13, 1976

[54] ADJUSTING MECHANISM FOR SKI BINDINGS

[75] Inventor: Erwin Weigl, Brunn am Gebirge, Austria

[73] Assignee: Gertsch AG, Zug, Switzerland

[22] Filed: July 2, 1974

[21] Appl. No.: 485,245

[30] Foreign Application Priority Data

July 4, 1973 Austria ..... 5881/73

[52] U.S. Cl. ..... 280/11.35 K

[51] Int. Cl.[2] ..... A63C 9/00

[58] Field of Search 280/11.35 K, 11.35 C, 11.35 A, 280/11.35 D, 11.35 E, 11.35 Y, 11.35 R; 9/310 AA

[56] References Cited

UNITED STATES PATENTS

| | | | |
|---|---|---|---|
| 2,614,858 | 10/1952 | Pierce, Jr. | 280/11.35 C |
| 3,102,279 | 9/1963 | Bennett | 9/310 AA |
| 3,133,296 | 5/1964 | Pierson | 9/310 AA |
| 3,137,014 | 6/1964 | Meucci | 9/310 AA |
| 3,314,687 | 4/1967 | Tiesler | 280/11.35 C |
| 3,361,435 | 1/1968 | Hvam | 280/11.35 |
| 3,489,424 | 1/1970 | Gertsch et al. | 280/11.35 K |
| 3,635,485 | 1/1972 | Gertsch et al. | 280/11.35 C |
| 3,752,491 | 8/1973 | Fend | 280/11.35 K |

FOREIGN PATENTS OR APPLICATIONS

| | | | |
|---|---|---|---|
| 276,180 | 11/1969 | Austria | |
| 306,592 | 4/1973 | Austria | |
| 1,954,512 | 5/1970 | Germany | |
| 1,280,719 | 10/1968 | Germany | |
| 469,492 | 4/1969 | Switzerland | |
| 2,123,966 | 9/1972 | France | |
| 405,129 | 7/1966 | Switzerland | 280/11.35 T |
| 17,179 | 8/1904 | Austria | 280/11.35 Y |
| 291,830 | 7/1971 | Austria | 280/11.35 K |
| 306,598 | 4/1973 | Austria | 280/11.35 N |
| 2,117,324 | 7/1972 | France | 280/11.35 K |
| 500,729 | 2/1971 | Switzerland | 280/11.35 K |

*Primary Examiner*—Robert R. Song
*Assistant Examiner*—Milton L. Smith
*Attorney, Agent, or Firm*—Woodhams, Blanchard and Flynn

[57] ABSTRACT

Adjusting mechanism for fastening a ski boot to a sole plate. In such a device there is provided a device for gripping one end, normally the heel, of the ski boot and a ratchet for determining the position of the gripping device with respect to the remainder of the sole plate. Same is spring loaded for normal engagement and manually operable for release. The ratchet teeth are oriented for permitting free movement of the gripping device in one direction, normally toward the toe of the ski boot, and for normally holding same against movement away therefrom. In alternative embodiments, the ratchet teeth may be provided on guide rods, on the edges of dovetail guides, or on a re-entrant device entering into a recess in the sole plate structure.

11 Claims, 7 Drawing Figures

ADJUSTING MECHANISM FOR SKI BINDINGS

FIELD OF THE INVENTION

The invention relates to an adjusting mechanism for ski bindings, in which a sole plate for fastening on the ski boot cooperates at least on one of its ends with a locking mechanism and in which there is provided a heel gripping member for holding the ski boot on the sole plate.

BACKGROUND OF THE INVENTION

Various kinds of adjusting mechanisms of the above-mentioned type are already known. Thus, Swiss Patent No. 500,729 describes a device in which at least one jaw of one part of two relatively adjustable parts is guided in a smooth bore in the other part and has a thread, with which a threaded nut cooperates. Said nut is held in a recess of the second part, and the adjustment of the two parts occurs through a relative rotation between a pin and threaded nut. For adjusting the heel gripping member to various boot sizes, cross bores are herein provided in the release plate into which the pin-shaped, threaded leg of the rectangularly bent adjusting bolt of the heel gripping member can be inserted from both sides. For the fine adjustment or adjusting to the boot, a threaded sleeve engages the threaded leg, which threaded sleeve forms the continuation for the heel gripping member.

Similar devices are described in Austrian Patent No. 291,830 and French Patent No. 2,117,324. A similiar construction which permits a rough adjustment has been shown in Austrian Patent No. 306,598. Here, however, a fine threaded adjustment is not obtained.

Even though all devices permit the adjustment to various boot sizes, the adjustment itself is somewhat complicated and, due to the danger of dirt getting into the cross bores, considerable cleaning operations are necessary. If, however, these cross bores are provided with covers — which is easily possible — then this results in additional expense.

The object of the invention is to produce an adjusting mechanism of the type described above, where the entire adjusting mechanism is stored in a closed part, namely in the sole plate. This overcomes the above-described disadvantages of the previous adjusting mechanisms and assures in addition a simple adjustment. Further, the invention permits also a finer adjustment in a single operation.

SUMMARY OF THE INVENTION

The purpose so described is attained according to the invention by providing a recess in the central zone of the sole plate which recess is penetrated in the longitudinal direction of the ski by at least one guide member, with which a longitudinally movable part of the sole plate cooperates engageably and disengagably.

The objectives of the invention are fully attained by the inventive construction. The guide member and the longitudinally movable part can form a closed unit so that only one operating member, which is constructed of a weather-resistant material, projects from the unit.

According to a preferred embodiment of the invention, the guide member comprises a longitudinal ratchet having teeth on at least one of its sides and, with this type of rack, a spring-tensioned pawl member engages same and can be disengaged by means of a pressure or lever element. A different embodiment comprises a guide member having a longitudinal ratchet which has at least on one of its sides openings, such as holes, slots, bores or the like, with which a spring tensioned locking element, such as a pin, bolt, tooth or the like, engages or can be disengaged by means of a pressure or lever element.

Both embodiments are based on the so-called rack principle which has been successful in other fields of technology. The advantages of such devices will therefore be familiar to one skilled in the art of machine or tool building and need no further discussion.

Another advantageous embodiment of the inventive adjusting mechanism comprises two longitudinal ratchets which are provided with inwardly directed teeth and a carriage riding thereon serves as a movable part in which there is provided a ratchet and pawl mechanism operable by a lever arm. This construction is characterized by its symmetric arrangement.

A further advantageous construction of this adjusting mechanism consists in that the ratchet and pawl mechanism has a cross guide, in which the pawl teeth are arranged transversely movably, wherein these have each in the central zone of the ratchet and pawl mechanism an opening with an inclined surface, which cooperate with a U-shaped member which has also inclined surfaces, to which member is hingedly connected the central part of the lever arm. It is further characterized in that in the free space between the two U-legs there is inserted a spring which holds the lever arm continuously in engaging condition for the teeth.

This embodiment forms a particularly strong unit, which, though it is slightly expensive, can be used particularly in ski bindings with higher requirements.

A further characteristic of the invention appears in that two racks are provided as a guide member and on the movable part, namely on the carriage, there are provided two spring loaded pawl members which can be operated from outside by means of a push button or the like and are provided with teeth or the like. This embodiment is characterized by its especially simple construction but here too the objectives of the invention are met.

A further embodiment of the inventive adjusting mechanism is characterized in that a holding part which is dovetailed in cross section is used as a guide member, which holding part cooperates with an also dovetailed portion of the carriage, wherein the ratchet and pawl mechanism is arranged between the two dovetailed parts, preferably in one of the horizontally extending sections of the same. Through this inventive measure, the central zone of the sole plate consists substantially of two parts.

An alternative embodiment of this inventive concept consists in that a holding part is used as a guide member, which holding part is approximately I-shape in cross section with an extended central zone and which holding part cooperates with a correspondingly formed counterpart of the carriage, wherein the ratchet and pawl mechanism is arranged between the two lateral guides or in the upper guide portion.

Finally, as a still further feature of the invention, it is possible for the front and/or the rear support portion of the sole plate to comprise the movable part. This embodiment has the advantage that no third part is used between the front and the rear part of the sole plate. Of course, one has to accept in this embodiment that after a certain adjustment of the front and/or the rear part, the guide member or the guide members project from the sole plate. Therefore this embodiment will only be acceptable for less demanding uses.

The invention will now be discussed more in detail in connection with the drawings, which represent various exemplary embodiments of the concept of the invention.

DETAILED DESCRIPTION

Figure 1:
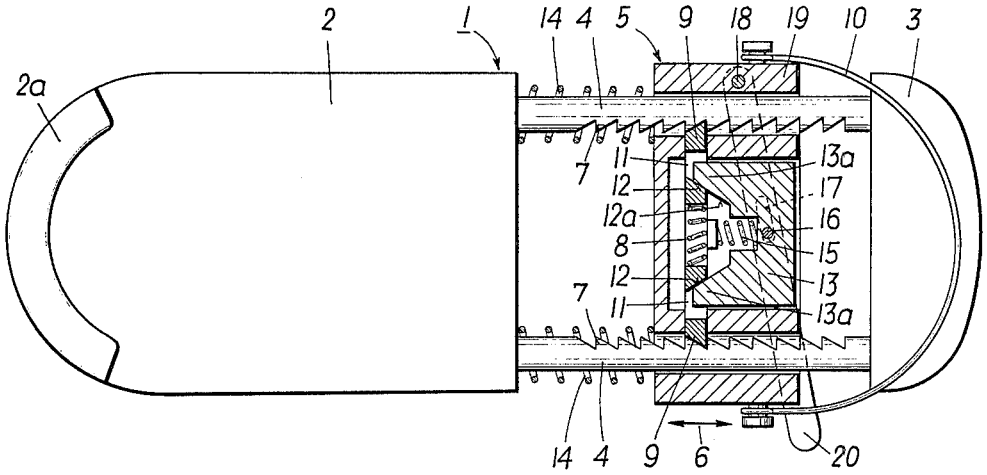
FIG. 1 is a top view of a first exemplary embodiment of an adjusting mechanism embodying the invention, the central area being shown in section with the cover plate removed.
Figure 2:
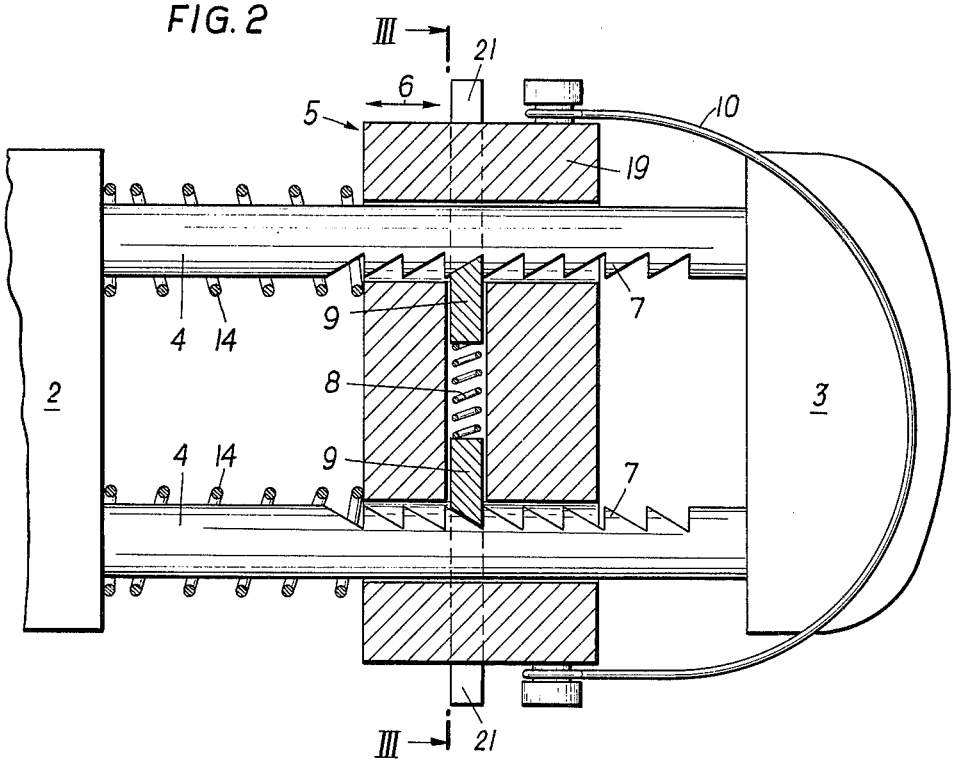
FIG. 2 shows a different embodiment with a simplified ratchet and pawl mechanism.

The sole plate 1 which is illustrated in a top view in FIGS. 1 and 2 has a front part 2 and a rear part 3. Longitudinally extending ratchets 4 are arranged between the parts 2 and 3 or secured in said parts 2 and 3. For a better understanding, both the lower part of the sole plate and also the cover plate of the movable part 5 are not shown. A movable part comprising a carriage 5 is movable in longitudinal direction on the toothed ratchets 4 as indicated by the double arrow 6. In the exemplary embodiments according to FIGS. 1 and 2, the ratchets 4 are provided wtih ratchet teeth 7 on their inner sides and can engage the pawl members 9. Said latter are constructed as single teeth and are loaded by the spring 8. In both cases a conventional heel gripping member 10 is arranged on the carriage 5. The carriage 5 is loaded by two helical coil compression springs 14 which continuously urge same rearwardly.

The above-described ratchet and pawl mechanism is identical for FIGS. 1 and 2. However, the operation of the pawl members according to FIGS. 1 and 2 differs; for this reason two different ratchet and pawl mechanisms will be described hereinafter.

According to the embodiment of FIG. 1, the pawl members 9 have each an opening 11 in their central zone. The inner sides of the openings are constructed with rearwardly inclined surfaces 12 a and cooperate with corresponding surfaces 12 of a member 13 which is substantially U-shaped in a top view and which is engaged by a pressure spring 15. The spring 15 is arranged in the central free zone between the legs 13*a* of the U-shaped member 13 and urges the member 13 away from the individual teeth 9. This urging is limited by a pin 16 which is arranged on the U-shaped member 13 and which engages a longitudinal slot 17 of a lever arm 20. Said lever arm is pivotally supported on a pin 18 which is inserted in the outer carriage part 19.

The inventive adjusting mechanism shown in FIG. 1 is operated by placing the ski boot (not illustrated) down onto the sole plate 1, pulling the lever arm 20 forwardly and moving the carriage 5 forwardly sufficiently in the direction of the arrow 6 that the heel gripping member 10 holds the ski boot in or on the front sole holding part 2*a*. The carriage 5 is released from the engaging position by moving the lever arm 20 forwardly. Through this movement the U-shaped member 13 is also moved forwardly and the inclined surfaces 12*a* of the legs 13*a* engage the inclined surfaces 12 of the pawl members 9 to move same toward each other against the force of the spring 8. Thus, the engagement of the pawl members (individual teeth) 9 is released. If, however, after the ski boot has been inserted, the lever arm 20 is released, the spring 15 becomes active, the U-shaped member 13 is moved backwardly and the individual teeth 9 each engage a respectively oppositely positioned tooth 7 of the ratchet 4.

There is no limitation with respect to the construction of the teeth of the ratchet 4 or of the individual teeth 9. Thus a fine tooth construction can be used; the condition for same is only that the teeth have a sufficient depth or height to assure a secure holding of the carriage 5 in each position. However, it is also easily possible and conceivable to adjust the heel gripping member 10 in a conventional manner — for example by using threads on one or both sides. In this case it is also possible to use a coarse tooth construction.

Figure 3:
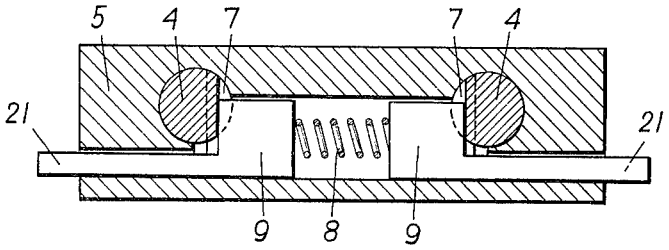
FIG. 3 is a cross-sectional view along the line II—II of FIG. 2, FIGS. 4*a* and 4*b* are a cross-sectional view of a dovetailed connection with two different ratchet and pawl mechanisms shown in the two cross-sectional halves.

The ratchet and pawl mechanism according to FIG. 2 has a more simple construction. Two push buttons 21 which cooperate with the individual teeth 9 are here provided, which push buttons are opposed by the spring 8 through the individual teeth 9. If the push buttons 21 are pressed from outside inwardly, the carriage 5 can be moved forwardly in the direction of the arrow 6. The adjustment of the carriage 5 backwardly is accomplished automatically by means of the spring 14. FIG. 3 illustrates in a cross-sectional view the construction of the ratchet and pawl mechanism preferred for this purpose.

Figures 4A, 4B:
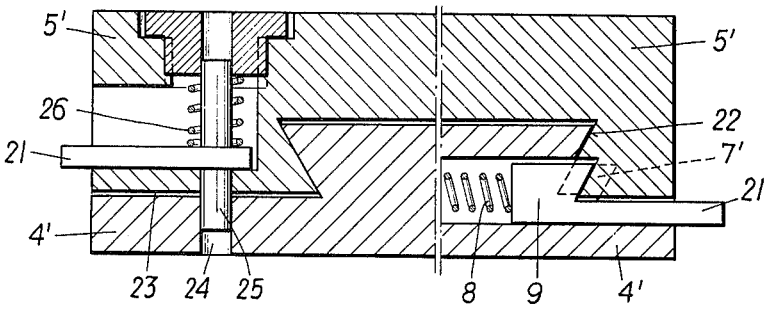

FIGS. 4*a* and 4*b* show one single holding part. The two cross-sectional halves show two different embodiments of the ratchet and pawl mechanism. The holding part 4' and the carriage 5' are constructed in a dovetailed relationship for engagement. In the right cross-sectional half (FIG. 4*a*) the ratchet and pawl mechanism is constructed as in FIG. 2 or 3. The teeth 7' can advantageously be embodied in the inclined extending part 22 of the dovetail. In the left cross-sectional half (FIG. 4*b*) the ratchet and pawl mechanism is provided in the horizontal portion 23 of the dovetail. For this purpose openings 24, for example in form of teeth, are provided in the holding part 4', which can be engaged selectively by a pin 25 comprising the locking element. Said pin 25 is loaded by a spring 26 and can be released manually in one direction.

Figure 5:
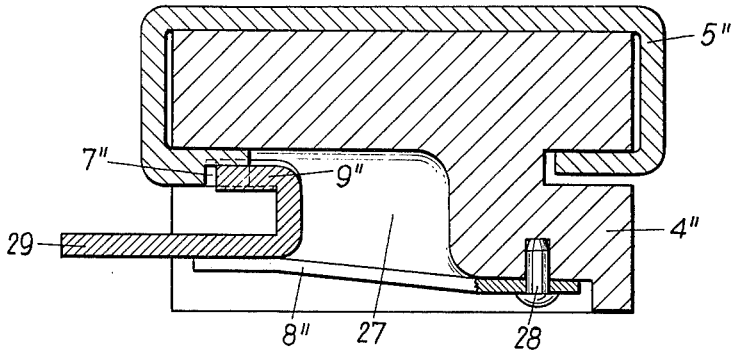
FIG. 5 is a cross-sectional view of a further example of the ratchet and pawl mechanism with one single guide member.

FIG. 5 illustrates an arrangement with a different kind of engaging means, same involving only holding parts 4'' and 5''. In this case the teeth 7'' are arranged in a downwardly directed manner on the lower part of the carriage 5'', said teeth extending into a recess 27 of the holding part member 4''. A tooth 9'' which is fastened to a leaf spring 8'' and which can engage the teeth of the carriage 5'' is arranged in the recess 27. The leaf spring 8'' is secured on the holding part 4'', for example with a rivet. The tooth 9'' has a lug 29, by means of which it can disengage the teeth 7'' against the action of the spring 8'' in the direction of the arrow 30.

Figure 6:
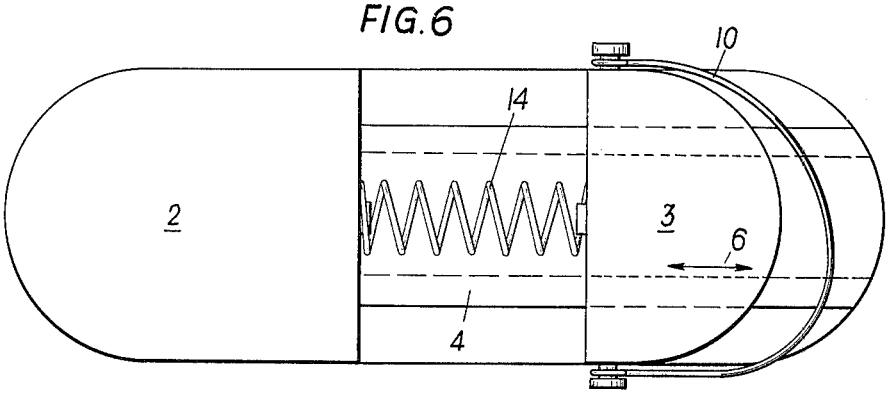
FIG. 6 is a top view of a further example with an adjustable rear support member for the sole plate.

FIG. 6 illustrates an exemplary embodiment for the case where the rear sole plate part 3 is constructed as the movable part.

The operation of the embodiments according to FIGS. 4 to 6 corresponds to the embodiments of FIGS. 1 to 3 and therefore does not need to be discussed further.

The invention is not limited to the illustrated exemplary embodiments. Various embodiments can be used without departing from the scope of the invention. For example it is possible to vary the described ratchet and pawl devices or ratchet and pawl mechanisms with respect to one another. To adjust the carriage it is possible to use in place of the compression spring a tension spring which is arranged in the rear sole part 3. This possibility exists also in the embodiments of FIGS. 1 and 2, where in each case compression springs 14 were used. To limit the adjustment of the U-shaped member 13 of FIG. 1, it is also possible to provide a shoulder. However, it is still further possible to recieve this U-shaped member 13 in a guide in the carriage 5 and limit the path by providing limit means in the inner part of the carriage 5. These embodiments have the advantage that slot 17 which cooperates with the pin 16 must not be designed to an exact fit but should have some play. FIG. 5 shows the possibility of arranging the teeth on the movable part and the pawl member on the holding part. This reversal is also possible in the other exemplary embodiments. In any case care is taken that the adjustment of the movable part, namely of the carriage is to occur automatically in one direction.

The embodiments of the invention in which an exclusive property or privilege is claimed are defined as follows:

1. An adjusting mechanism for adjusting the spacing between toe and heel members which engage the toe and heel, respectively, of a ski boot, comprising:

plate means for engaging a sole of a ski boot, said plate means including a toe member having toe engaging means thereon for engaging the toe portion of said ski boot and a heel member having heel engaging means thereon for engaging the heel portion of said ski boot, said toe member and said heel member being relatively movable toward and away from each other;

guide means connected to said toe member and said heel member for guiding said relative movement of said toe member and said heel member toward and away from each other;

first securement means on said guide means;

second securement means on at least one of said toe member and said heel member cooperably engaging said first securement means to permit said toe member and heel member to be freely movable toward each other, said cooperably engaging first and second securement means including means for preventing a movement of said toe member and heel member away from each other;

release means for releasing the cooperable engagement between said first and second securement means to facilitate a movement of said toe and heel members away from each other; and resilient means for urging said toe member and said heel member away from each other.

2. An adjusting mechanism according to claim 1, wherein said guide means comprises at least one elongated guide member;

wherein said first securement means includes a plurality of ratchet teeth on at least one of its sides;

wherein said second securement means includes a pawl member mounted on at least one of said toe member and said heel member and further includes a spring for resiliently urging said pawl into engagement with said teeth; and wherein said release means comprises a lever operated means pivotally secured to said one of said toe member and said heel member for effecting a release of the engagement between said ratchet and said pawl.

3. An adjusting mechanism according to claim 1, wherein said release means comprises means defining a first opening in said one of said toe member and said heel member, means defining a plurality of second openings in said guide means, said first opening in said one of said toe member and said heel member being alignable with said second opening, a locking element and a spring for urging said locking elements into said first opening and one of said second openings; and wherein said release means comprises a lever operated means for removing said locking element from said second opening against the urging of said spring.

4. An adjusting mechanism according to claim 1, wherein said guide means includes a holding part which in cross section is dovetailed, said holding part cooperating with another dovetailed part on one of said toe member and said heel member, wherein said ratchet is arranged on one of the inclined surfaces of the two dovetailed parts.

5. An adjusting mechanism according to claim 1, wherein said guide means includes a holding part having an approximate I-shape in cross section and has an extended central zone with a recess therein;

wherein said one of said toe member and said heel member is guided for movement on said holding part and has generally a C-shape fitting over the cross bar at one end of said I-shaped holding part so that the edges of the C-shaped member fit under said cross bar and, wherein said ratchet and said pawl is arranged between said edge of said C-shaped member and said holding part.

6. An adjusting mechanism according to claim 5, wherein said ratchet consists of teeth arranged on the lower end edge of said C-shaped member and cooperate with a tooth on said pawl secured on said holding part by means of a leaf spring and provided with a lug thereby rendering said pawl movable relative to said ratchet.

7. An adjusting mechanism according to claim 1, wherein said toe member and said heel member are the front and the rear support portions, respectively, of said plate means.

8. An adjusting mechanism according to claim 1, wherein said plate means comprises a front member and a rear member, said front member constituting said toe member, said front and rear members being spaced from each other and connected together by at least one guide member, said heel member being mounted on said guide member between said front and rear members for movement toward and away from said front and rear members;

wherein said first securement means includes a plurality of ratchet teeth on said guide means; and wherein said second securement means includes a pawl mounted on said heel member engaging said ratchet teeth, said pawl permitting a free movement of said heel member toward said front member but preventing a corresponding movement away from said front member toward said rear member.

9. An adjusting mechanism for adjusting the spacing between toe and heel members which engage the toe and heel, respectively, of a ski boot, comprising:

plate means for engaging a sole of a ski boot, said plate means including a toe member having toe engaging means thereon for engaging the toe portion of said ski boot and a heel member having heel engaging means thereon for engaging the heel portion of said ski boot, said toe member and said heel member being relatively movable toward and away from each other;

guide means connected to said toe member and said heel member for guiding said relative movement of said toe member and said heel member toward and away from each other, said guide means including a pair of longitudinal rods;

a pair of opposed ratchets one on each rod with inwardly directed teeth;

a pair of pawl members on at least one of said toe member and said heel member cooperably engaging said ratchets to permit said toe member and heel member to be freely movable toward each other, at least one spring for urging each of said pair of pawls into engagement with one of said ratchets, said cooperably engaging pawls and ratchets including means for preventing a movement of said toe member and heel member away from each other;

a helical coil compression spring encircling said pair of longitudinal rods; and release means for releasing the cooperable engagement between said pawls and ratchets to facilitate a movement of said toe member and heel member away from each other under the urging of said spring.

10. An adjusting mechanism according to claim 9, wherein said release means comprises a cross guide in one of said toe member and said heel member in which said pawls are arranged for movement transverse of said guide means;

wherein each of said pawls has an opening therein with a first inclined surface in said opening, said release means further comprising a U-shaped member having a pair of second inclined surfaces thereon each engaging one of said first surfaces and lever operated means pivotally secured to said one of said toe member and said heel member for effecting a release of the engagement between said ratchets and said pawls, said U-shaped member being hingedly connected to the central part of said lever operated means and wherein said spring is mounted in the free space between the two U-legs of said U-shaped member for holding said pawls continuously in engaging condition with said ratchets.

11. An adjusting mechanism according to claim 9, wherein said release means includes a push button on each pawl on a side thereof remote from said spring urging said pawls into engagement with said ratchets whereby a pushing on said push buttons will effect a release of said pawls from engagement with said ratchets against the urging of said spring.

* * * * *